US007093554B1

(12) United States Patent
Mah

(10) Patent No.: US 7,093,554 B1
(45) Date of Patent: Aug. 22, 2006

(54) EASY ACCESS POWER SUPPLY UNDERWATER MOTIVE DEVICE

(75) Inventor: Pat Y. Mah, Kowloon (HK)

(73) Assignee: Daka Research Inc., Tortolla (VG)

( * ) Notice: Subject to any disclaimer, the term of this patent is extended or adjusted under 35 U.S.C. 154(b) by 22 days.

(21) Appl. No.: 11/102,302

(22) Filed: Apr. 8, 2005

(51) Int. Cl.
*B63C 11/46* (2006.01)

(52) U.S. Cl. ..... 114/315; 440/6

(58) Field of Classification Search ..... 114/315; 440/6

See application file for complete search history.

(56) References Cited

U.S. PATENT DOCUMENTS

| | | | | |
|---|---|---|---|---|
| 5,105,753 | A * | 4/1992 | Chih et al. | 114/315 |
| 5,634,423 | A * | 6/1997 | Lashman | 114/315 |
| 6,106,034 | A * | 8/2000 | Allen | 292/241 |
| 6,443,087 | B1 * | 9/2002 | Stecker, Sr. | 114/315 |

* cited by examiner

*Primary Examiner*—Stephen Avila
(74) *Attorney, Agent, or Firm*—Curtis L. Harrington

(57) ABSTRACT

An underwater motive device provides an integrated front cone and handle assembly with a mechanical link between the front cone and handle assembly to the main body of the unit which includes the battery compartment, motor, propeller and guard. The sealing between the cone and handle assembly and main body is accomplished by a double annular projecting seal having a rear ribbed portion extending deep into a slot in the main unit, and a forward more rounded ribbed unit which provides sealing in a front cone and handle assembly chamber. A battery cassette is provided for loading a number of commercially available flash light type cyclindrical cells, the battery cassette having an uneven pentagonal cross section so that it is inserted into a matching uneven pengagonal cross section within the main unit, but only where the battery cassette is of the proper orientation. The battery cassette also has a female plug which mates with a male plug extending from the rear of the battery cassette matching space within an opening in the main housing. A mechanical link enables handles located on the forward nose cone to mechanically communicate with a switch on the inside of the main housing through a flexible membrane on the seal.

7 Claims, 2 Drawing Sheets

29
39
49
65
59
27
67
61
57
35
37
21
47
41
55
45
53
51
25
43
33
31
23

EASY ACCESS POWER SUPPLY UNDERWATER MOTIVE DEVICE

FIELD OF THE INVENTION

The present invention relates to improvements in the technology relating to in water and underwater mechanical motive structures and particularly to improvements relating to an underwater device which has a more commercially available and easier to change power supply and, and has an improved access structure which stably enables easier access.

BACKGROUND OF THE INVENTION

Powered underwater motive devices have been known since the 1950's. Most of those earlier devices were metal and were built like small submarines. Access was had through hatches which had to be securely bolted or clamped in order to resist taking on water at depth. Water is harmful to both motors and batteries and must be sealed out. As a result, the underwater motive devices were large, bulky and designed with a mind to limit outside access to limit the sealing areas provided for service access.

Recent improvements in underwater motive devices have related to the safety of operation, including a slight delay in starting to prevent inadvertent operation. In addition, sealed chambers have been introduced to keep water out of the battery and motor compartments.

However, for small motive devices, providing an integral housing complete with sealing of the battery and motor compartment has proved difficult for users to easily access the battery and motor compartment. The only alternative to a strong seal was unacceptable as a weaker seal would cause the taking of the device to depth to result in cyclical pressure leakage. Where the device is used in salt water, even the slightest leakage can be disastrous.

Seals achieve their integrity by resilient sealing force and area. Both force and area contribute to the necessity for high force of replacement and removal. In a prior underwater motive device, air pressure and a pump were utilized to provide internal assist pressure to unseal the battery and motive compartments. Battery exchange required some setup and interconnectivity time.

In another underwater motive device, a cam system is used to provide significant sealing and un-sealing force. In underwater motive devices which are more oblong, the placement of battery, actuaction switch, sealing member, motor and the like can be arranged in a more orderly fashion. Further, where an underwater motive device is of a larger variety, it is expected that a larger more specialized battery will be supplied and which will have a longer residence time. Further, longer, more powerful devices will achieve greater depth for longer periods of time and the ability to seal out high pressure is paramount.

Where a power supply, typically a battery is to be used, the design of underwater motive devices can generally allow sealing to be accomplished most effectively during manufacturing, but not around the battery. Batteries for such service should be sealed to the extent possible but most are not made for pressurized submersion for any period of time. Any water leakage and especially salt water leakage can ruin a battery. Where an underwater motive device has a larger power supply a larger and more expensive battery is at risk. Further, as the assembly of the underwater motive device is large, larger seals and more complex battery and battery connection arrangements have to be made. For smaller underwater motive devices, there are significant problems associated with the placement of the handles, operating switch, motor and accommodating battery change out.

Another problem for underwater motive devices is the sophistication and time required in battery changeout. For professional divers, a larger more expensive unit which is capable of longer operation is required. Because commercial divers are paid a high hourly contract rate, the equipment used will be dictated by minimizing battery changeout and maintenance time. Underwater motive devices have generally not been available to more economically minded swimmers and skin divers.

Any more simplistic underwater motive device should be more available based upon both cost and operability. To expand the useage of the underwater motive device, younger and weaker users should be able to operate a much more inexpensive device. The aspects to be overcome are cost, ability to access the battery department and the ability to operate from batteries which are less specialized and more common, as well as lowering the sophistication of the individuals who can maintain and operate the underwater motive device.

SUMMARY OF THE INVENTION

An underwater motive device provides an integrated front cone and handle assembly with a mechanical link between the front cone and handle assembly to the main body of the unit which includes the battery compartment, motor, propeller and guard. The sealing between the cone and handle assembly and main body is accomplished by a double annular projecting seal having a rear ribbed portion extending deep into a slot in the main unit, and a forward more rounded ribbed unit which provides sealing in a front cone and handle assembly chamber.

A battery cassette is provided for loading a number of commercially available flash light type cyclindrical cells, the battery cassette having an uneven pentagonal cross section so that it is inserted into a matching uneven pengagonal cross section within the main unit, but only where the battery cassette is of the proper orientation. The battery cassette also has a female plug which mates with a male plug extending from the rear of the battery cassette matching space within an opening in the main housing. The battery cassette remains unconnected until it is insertion to eliminate any possibility of injury from handling wiring, or manually touching connectors to be connected.

A mechanical link enables handles located on the forward nose cone to mechanically communicate with a switch on the inside of the main housing through a flexible membrane on the seal.

BRIEF DESCRIPTION OF THE DRAWINGS

The invention, its configuration, construction, and operation will be best further described in the following detailed description, taken in conjunction with the accompanying drawings in which.

DETAILED DESCRIPTION OF THE PREFERRED EMBODIMENT

Figure 1:
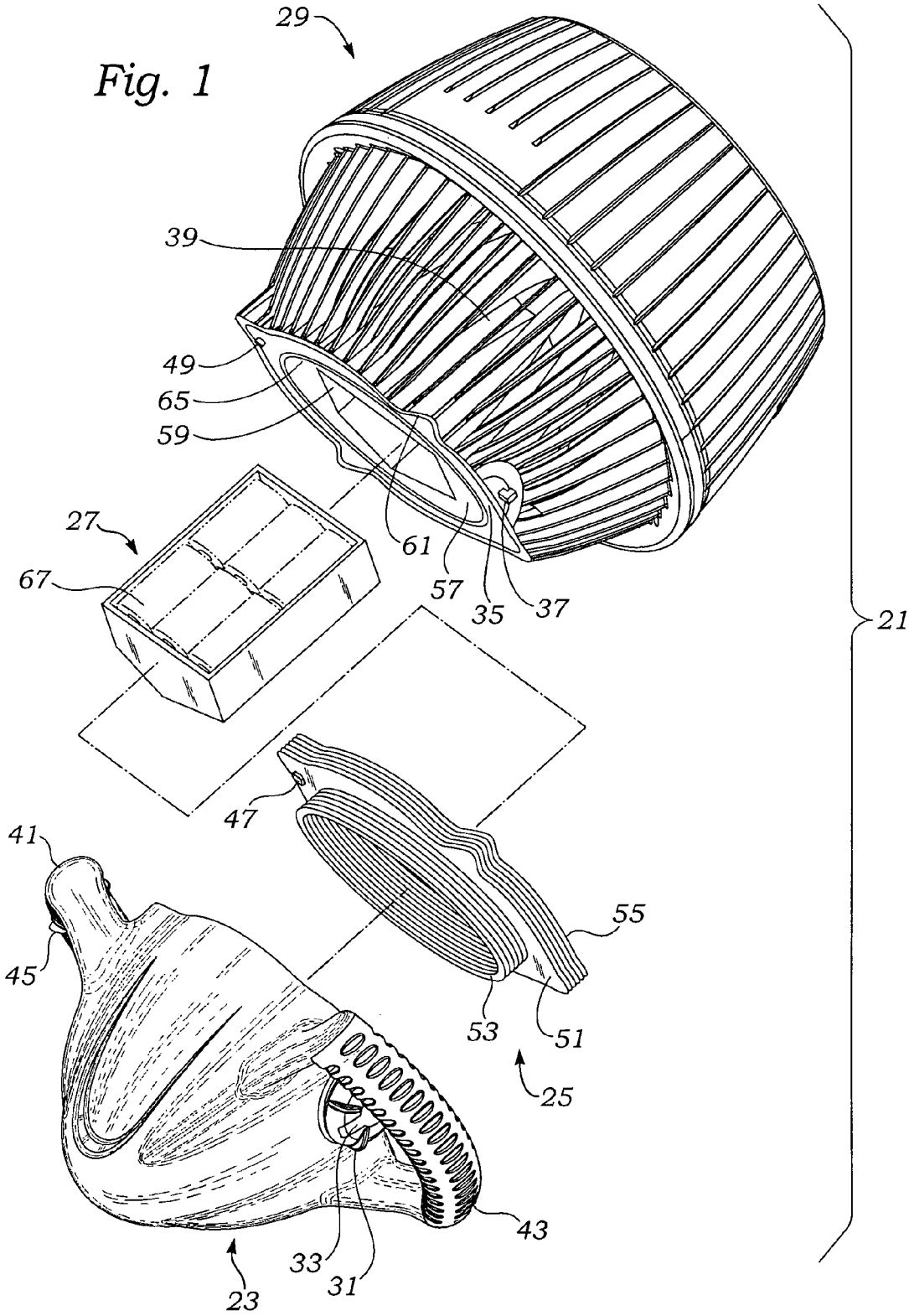
FIG. 1 is a perspective exploded view of the underwater motive device of the present invention illustrating the front cone and handle assembly, seal, battery cassette and main housing.

The description and operation of the invention will be best initiated with reference to FIG. 1. An underwater motive device 21 is shown in exploded view and includes a front cone and handle assembly 23, seal 25, battery cassette 27 and main motor and propeller housing 29, which contains a motor operably connected to a propeller, with the propeller further surrounded by protective structures which will permit water to enter and be forced out while protecting the user from direct contact with the bladed propeller.

The front cone and handle assembly 23 has a pair of circular latch members 31, only one of which is seen in FIG. 1. Each of the circular latch members 31 includes a snap cover 33 which serves to both cover and capture a main threaded member (not seen) which secures the circular latch member 31 to the front cone and handle assembly 23. The circular latch member 31 has an opening (not seen in FIG. 1) which admits a small latch 35 seen surrounded by a circular flat area 37 on the main motor and propeller housing 29. Once the circular latch member 31 is turned, the small latch 35 is both captured and pulled toward the circular latch member 31 to complete the attachment and sealing of the front cone and handle assembly 23 to the main motor and propeller housing 29. A portion of motor 39 is seen.

A pair of handles 41 and 43 are seen with handle 41 having a protruding actuation button 45 which operates a link located just to the inside of the front cone and handle assembly 23 and through a specialized actuation area 47 on the seal 25 and then to a switch 49 located on the face of the main motor and propeller housing 29. The specialized actuation area 47 is a structure which can allow the switch 49 to be actuated without undue force through the seal 25. Since the area surrounding specialized actuation area 47 will not be called upon to seal or to be impressed by any force from either the front cone and handle assembly 23 or the main motor and propeller housing 29, it can be thin enough to provide no significant additional force requirements to operate the switch 49 beyond the spring loading of switch 29 itself.

Turning attention again to the seal 25, the seal 25 has a main planar portion 51 with a forward projecting generally rounded first annular portion 53 and a rearward projecting generally housing following second portion 55. The forward projecting generally rounded first annular portion 53 simply engages the gently conically sloping smooth inside portion of the front cone and handle assembly 33 (not seen in FIG. 1) and forms a seal to protect the battery cassette 27 from moisture.

Referring to the main motor and propeller housing 29, at the left front is a front face 57 haiving a shaped opening 59 matching the overall cross section of the battery cassette 27. Note that the outermost periphery of the front face 57 has four corner devices. A thin slot 61 extends just inside the outermost periphery of the front face. Thin slot 61 is about one to two centimeters deep and accommodates the about the and accommodates the rearward projecting generally housing following second portion 55 of the seal 25. The rearward projecting generally housing following second portion 55 has a ribbed shape and is typically packed with silicone on the inside and outside and is also typically installed at the factory although it can be removed and re-packed with silicone if desired. By providing a deep rearward projecting generally housing following second portion 55, moisture would have to enter the space between the main planar portion 51 of the seal 25 and the thin edge of the front face 57 outward of the thin slot 61, and then past the interface between the inwardly facing wall of the thin slot 61 and the outward face of the deep rearward projecting generally housing following second portion 55 of the seal 25, and then around the distal edge of the deep rearward projecting generally housing following second portion 55 of the seal 25, and then between the outwardly facing wall of the thin slot 61 and inward face of the deep rearward projecting generally housing following second portion 55 of the seal 25, before any moisture would be able to enter the shaped opening 59.

By providing significant depth of the deep rearward projecting generally housing following second portion 55 of the seal 25, controlled waterproofing is attained without sigificant pressure structures. At the front of the seal 25, the forward projecting generally rounded first annular portion 53 is flexible, but a supporting projection 65 which is inward of the slot 61 can provide additional support to the flexible forward projecting generally rounded first annular portion 53. As the front cone and handle assembly 23 is brought onto the front of the forward projecting generally rounded first annular portion 53, the ribs of the forward projecting generally rounded first annular portion 53 begin to frictionally sweep and seat with respect to the internal smooth matching surface of the inside of the front cone and handle assembly 23 to form a seal. Any moisture entering between the main planar portion 51 and the rear edge of the front cone and handle assembly 23 must flow past the forward projecting generally rounded first annular portion 53. Any moisture entering would likely not reach the battery cassette 27 as it is not designed to hold liquid. Any liquid entering the shaped opening 59 cannot travel farther as the shaped opening 59 is closed. Only a male electrical plug (now shown) extends from the rear wall of the shaped opening 59.

The battery cassette 27 is seen as containing a number of batteries 67. In the preferred embodiment, ten such batteries 67 will fit into the cassette to give an overall nominal voltage of about 15 volts. Because the cassette 27 is fitted with tabs and springs, there is no question about the orientation of the batteries, the negative end of the battery 67 going against a spring with the positive end against a tab.

The exploded view of FIG. 1 illustrates how easy it would be for even a young child or a weak adolescent, to replace the batteries 67. Once the underwater motive device 21 is removed from the water, the pair of circular latch members 31 are turned to free the front cone and handle assembly 23 from the main motor and propeller housing 29. The battery cassette 27 is removed and the individual batteries 67 are removed from the cassette 27. A fresh set of batteries are replaced in the battery cassette 27 and the battery cassette 27 is replaced into the shaped opening 59. The orientation of the battery cassette 27 can only be two ways. The correct way is for the female plug on the battery cassette 27 to be directed into the shaped opening 59. When this happens, electrical connection is made and the battery cassette 27 is seated into the shaped opening 59.

In the event that the the battery cassette 27 is inserted into the shaped opening 59 in a reverse position, the female connector (not shown) would be predominant and, the battery cassette 27 would not seat and the front cone and handle assembly 23 would not be able to be moved into position such that the pair of circular latch members 31 could engage the small latches 35 to even allow enagement to begin. Thus, the foolproof level of the system of the underwater motive device 21 is high.

Figure 2:
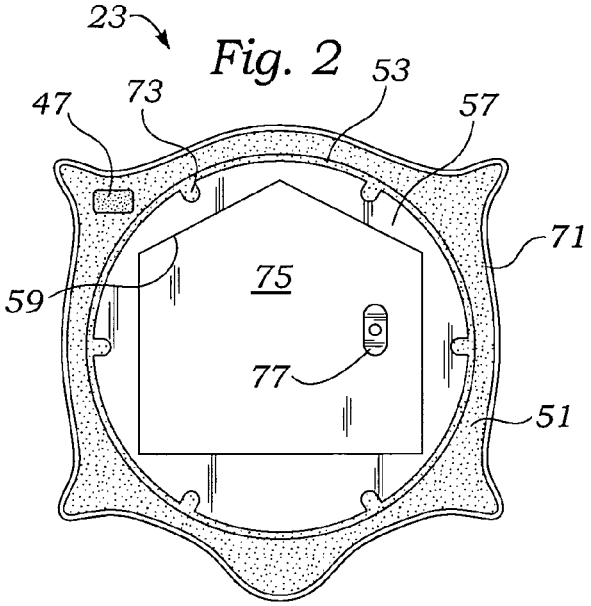
FIG. 2 is a view looking into the front face of the main housing and illustrating further details thereof, including a very closely following rearward projecting generally housing following second portion of the seal.

Referring to FIG. 2, a view looking into the front face 57 of the main motor and propeller housing 29 illustrates further details thereof. As stated earlier, a very closely following rearward projecting generally housing following second portion 55 of seal 25 extends into a thin slot 61. The thin slot 61 is formed by some of the material contiguous to the front face 57 and by a thin layer of material 71 of the main motor and propeller housing 29.

The seal 25 also includes a series of insertion tabs 73 which extend inwardly, inside of the forward projecting generally rounded first annular portion 53, and inserted at right angles into support bores (not shown) so as to provide additional fixation for the seal 25. As can be seen the seal 25 can be seen to extend from the tabs 73 to the forward projecting generally rounded first annular portion 53, thence throughout the main planar portion 51 and then dissappearing at the point of turning toward and into the thin slot 61 (not seen in FIG. 2) adjacent the thin layer of material 71.

Also seen in FIG. 2 is a rear wall 75 which supports a two prong plug 77 which is oriented and positioned to insert into a female plug (not shown) on the battery cassette 27. Also shown in plan view is the specialized actuation area 47 which surrounds the switch 49 by a thin projecting encasement of material which is preferably completely continuous wiht the material of the seal 25.

Figure 3:
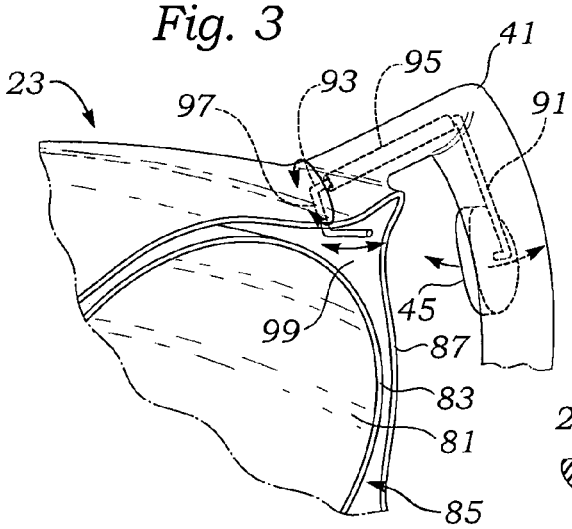
FIG. 3 illustrates a view looking into the rear portion of the front cone and handle assembly in a partially transparent view to further illustrate details of the mechanical actuation link used to switch the motor "on" and "off"

Referring to FIG. 3, a view looking into the rear portion of the front cone and handle assembly 23 in a partially transparent view to further illustrate details of the front cone and handle assembly 23. A smooth inner surface 81 of a conical projection 83 is provided for engagement with the forward projecting generally rounded first annular portion 53 of seal 25. In the embodiment shown, the smooth inner surface 81 is provided in such a way that a space 85 exists between the conical projection 83 and an external wall 87 of the conical projection 83 of the front cone and handle assembly 23. In the configuration shown, the conical projection 83 forms a seal for the area surrounding a portion of the battery cassette 27. Any water which may enter the space 85, especially through the periphery of the protruding actuation button 45 and the handle 41 will not be able to enter the space inside the conical projection 83.

The view inside the handle 41 is transparent and although one set of structures will be shown, other structures not shown can be used to actuate the switch 49 just as well, and these are only one set of structures. The protruding actuation button 45 is connected to a first pivoting link 91 which pivots about a rotating link 93 which may be supported within a rotation sleeve 95. Rotation sleeve can be provided for a close fit for rotation sleeve 95, or for friction compatibility. A second pivoting link 97 is connected to the opposite end of the rotating link 93. At the distal end of the second pivoting link 97 a projection finger 99 which is angled with respect to the second pivoting link 97.

The arrangement shown translates depression of the protruding actuation button 45 into a rearward pivoting action of the first pivoting link 91, with resultant rotation of the rotating link 93, which causes rearward pivoting of the second pivoting link 97 which causes the projection finger 99 to extend rearward and contact the switch 49 through the specialized actuation area 47 of the seal 23. This mechanical arrangment has allowed the handles 41 and 43 to be mounted on the forward cone in this instance. The mechanical arrangement is a novel method of eliminating the problems which would be associated with having an electrical connection between the front cone and handle assembly 23 and the main motor and propeller housing 29. This in turn has allowed an underwater motive device 21 having an overall shorter length with handles 41 and 43 located more forwardly for greater stability. The mechanical arrangement which enables actuation through the seal 23 without breaching its prophylactic integrity similary does not create the problems which a direct mechanial linkage would create.

Figure 4:
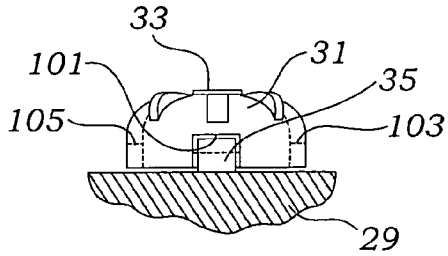
FIG. 4 is a sectional view taken through a portion of the main housing near and slightly rearward of the small latch to show the approach of the circular latch members and an opening which admits the small latch into the inner periphery of the circular latch member.

Referring to FIG. 4, a sectional view taken through a portion of the main motor and propeller housing 29 near and slightly rearward of the small latch 35, is seen. The small latch 35 is positioned such that an opening 101 in the circular latch members 31 is aligned with the small latch 35 to enable the main motor and propeller housing 29 and its small latch 35 to be brought forward with respect to front cone and handle assembly 23.

This action occurs on both sides of the front cone and handle assembly 23. Also seen in FIG. 4 is an internal table 103 on the right side of circular latch member 31 which will be brought underneath an upper projecting portion of the small latch member 35. An internal table 103 on the left side of circular latch member 31 can be brought underneath a corresponding upper projecting portion of a matching the small latch member (not shown) within the circular latch member 31 in order that the circular latch member 31 can act to evenly hold two latch members together, as will be seen.

Figure 5:
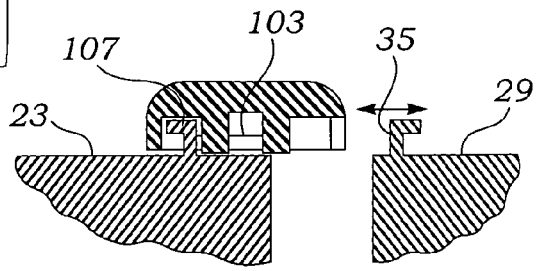
FIG. 5 is a cross sectional view of the circular latch member seen in FIG. 4, but taken at a right angle with respect to the section seen in FIG. 4 to illustrate the first step in dual engagement of both a small latch member and an oppositely located internal latch member 107.

Referring to FIG. 5, a cross sectional view of the circular latch member 31 at a right angle to the section seen in FIG. 4 illustrates both the small latch member 35 and an oppositely located internal latch member 107. As can be seen the latch members 35 and 107 each have an upper projecting portion underneath which the internal tables 103 and 105 of the circular latch member 31 will fit to form a more stable semi-locked position. This enables the circular latch member 31 to hold the latch members 35 and 107 evenly and will not place any tortion on a central threaded member about which the circular latch member 31 rotates (not shown and removed for simplicity and to enable viewing of the internal table 103.

Figure 6:
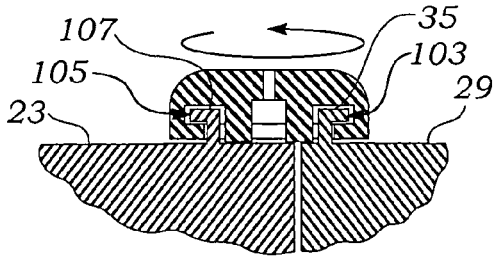
FIG. 6 is a cross sectional view of the circular latch member seen in FIG. 5 to illustrate the final position for locked engagement of both a small latch member and an oppositely located internal latch.

Referring to FIG. 6, once the main motor and propeller housing 29 is brought forward with respect to front cone and handle assembly 23, the circular latch member 31 can be rotated so that the internal tables 105 and 103 of the circular latch member 31 will fit underneath the latch members 107 and 35, respectively, to hold the main motor and propeller housing 29 and front cone and handle assembly 23 together.

Figure 7:
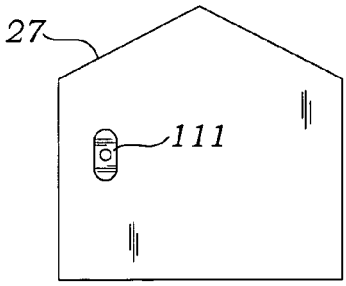
FIG. 7 is an end view of the battery cassette 27 and illustrating a female plug compatible with the mail plug seen in FIG. 2.

Referring to FIG. 7, a view of oone possible configuration of the battery cassette 27 illustrates an appropriately positioned female plug 111 which is compatible with and engagable with respect to the male two prong plug 77 seen in FIG. 2.

While the present invention has been described in terms of an underwater motive device, & more particularly to a particular structure and system which utilizes a user-friendly battery access system, controller which provides power delay, and ease of servicing, this mechanism can be applied to other devices.

Although the invention has been derived with reference to particular illustrative embodiments thereof, many changes and modifications of the invention may become apparent to those skilled in the art without departing from the spirit and scope of the invention. Therefore, included within the patent warranted hereon are all such changes and modifications as may reasonably and properly be included within the scope of this contribution to the art.

What is claimed is:

1. An underwater motive device comprising:

a front cone and handle assembly, having at least one handle having a protruding actuation button for operating said underwater motive device between an "on" and and "off" position;

a main housing enclosing an opening, and from which said front cone and handle assembly can be selectably detached;

a seal having a forward projecting first annular portion for engaging a surface of said front cone and handle assembly, a main portion lying between said a front cone and handle assembly and said main housing, and a rearward projecting portion for engaging a surface of said main housing;

a battery for fitting within said opening; and a circular latch supported and rotatable with respect to one of said main housing and said front cone and handle assembly for simultaneously engaging said main housing to said front cone and handle assembly.

2. The underwater motive device as recited in claim 1 wherein at least one of said forward projecting first annular portion and said rearward projecting portion have ribs for facilitating the capture of a sealant.

3. The underwater motive device as recited in claim 1 wherein said rearward projecting portion of said seal for engaging a surface of said main housing generally follows closely adjacent the exterior portion of said main housing and is located within a thin slot formed in said main housing closely adjacent said exterior portion of said main housing.

4. The underwater motive device as recited in claim 1 wherein said battery is located within a battery cassette having a first plug member and wherein said main housing includes a second plug member compatible and interfittable with said first plug member located within said opening for engagement with said first plug member when said battery cassette is inserted into said main opening of said main housing.

5. The underwater motive device as recited in claim 1 and further comprising:

a switch supported by said main housing; and a mechanical link connected between said protruding actuation button and a deformable portion of said seal, for actuating said switch through said deformable portion of said seal.

6. The underwater motive device as recited in claim 5 wherein said mechanical link further comprises a first pivoting link having a first end in mechanical force communication with said protruding actuation button, and a second end;

a rotating link having a first end attached to said second end of said first pivoting link, and a second end, said rotating link supported by said front cone and handle assembly;

a second pivoting link having a first end connected to said second end of said rotating link, and a second end;

a projection finger having a first end in force communication with said second end of said second pivoting link, and a first end for contacting said deformable portion of said seal.

7. The underwater motive device as recited in claim 1 wherein said front cone and handle assembly has a first protruding latch member and wherein said main housing has a second protruding latch member and wherein said circular latch pivotally depends from one of said front cone and handle assembly and said main housing, and acts to hold said first and second protruding latch members together independently of said pivotal dependence from one of said front cone and handle assembly and said main housing.

* * * * *